United States Patent [19]

Herbst et al.

[11] Patent Number: 4,898,299

[45] Date of Patent: Feb. 6, 1990

[54] PUSH AND DRINK LID

[75] Inventors: David H. Herbst, Ocean City, Md.; Chris E. Boes, LaRue, Ohio

[73] Assignee: Imperial Cup Corporation, Kenton, Ohio

[21] Appl. No.: 163,623

[22] Filed: Mar. 3, 1988

[51] Int. Cl.[4] ..... B65D 47/10

[52] U.S. Cl. ..... 220/90.4

[58] Field of Search ..... 220/90.2, 90.4, 90.6, 220/265, 266, 267, 268, 271, 207, 208; 229/103.1, 1.56, 906.1; 215/250, 253, DIG. 7; 222/541

[56] References Cited

U.S. PATENT DOCUMENTS

| | | | |
|---|---|---|---|
| 3,003,668 | 10/1961 | Sherlock et al. | 220/265 |
| 3,307,746 | 3/1967 | Edwards | 220/265 |
| 3,860,162 | 1/1975 | Schultz . | |
| 3,927,794 | 12/1975 | Erdman . | |
| 4,081,103 | 3/1978 | Zoellick . | |
| 4,113,135 | 9/1978 | Yamazaki . | |
| 4,138,033 | 2/1979 | Payne et al. . | |
| 4,184,604 | 1/1980 | Amberg et al. . | |
| 4,186,842 | 2/1980 | Albert . | |
| 4,190,174 | 2/1980 | Haimowitz . | |
| 4,210,256 | 7/1980 | Amberg et al. . | |
| 4,438,865 | 3/1984 | Scatteregia | 220/90.4 |
| 4,441,623 | 4/1984 | Antoniak . | |
| 4,503,992 | 3/1985 | Sitko et al. | 220/90.4 |
| 4,518,096 | 5/1985 | Winstead . | |
| 4,582,214 | 4/1986 | Dart et al. | 220/90.4 |
| 4,615,459 | 10/1986 | Clements . | |
| 4,738,373 | 4/1988 | DeParales | 220/90.4 |
| 4,756,440 | 7/1988 | Gartner | 220/90.4 |

*Primary Examiner*—Harvey C. Hornsby
*Assistant Examiner*—Joseph S. Machuga

[57] ABSTRACT

A container lid can be used for open-mouthed containers having a peripheral curl about the rim of the container. This peripheral curl defines a rim receiving cavity which may be snap fit over the rim of the container to attach the lid to the container. The container may thereafter be effectively closed by the lid. This lid may additionally have a central web portion for providing support for the lid and a drink-through element having a raised element within a well portion of this drink-through element. By applying a downward force to a top surface of the raised element, eye-shaped slits may be formed at frangible areas adjacent the corners of this element. These eye-shaped slits permit contents within the container to be discharged therethrough. For instance, a beverage may be held in the container. After applying a downward force to the raised element to form slits in the container lid, the beverage may be ingested directly through the lid. This lid arrangement may be easily handled and the pressure applied to the element may be applied without extra care and great force. The shape and size of the raised element may be varied in order to vary the size the slits formed and to therefore vary the rate at which the contents of the container may be discharged therethrough. The container lid is stackable similar to existing lids and anti-compacting lugs may be provided on these lids to prevent compacting or sticking of the lids while permitting the lids to be evenly stacked prior to use.

20 Claims, 2 Drawing Sheets

PUSH AND DRINK LID

BACKGROUND OF THE INVENTION

1. Field of the Invention

The present invention relates to disposable, detachable, drink-through beverage container lids and the like. The container lid has a peripheral curl defining a rim receiving cavity, a web arrangement, and a drink-through portion having a well with a raised element therein. This well is initially sealed but may have openings formed therein when a slight pressure is applied against the top surface of the raised element. This slight pressure will cause slits to be formed at frangible areas adjacent the corners of the raised element such that liquid within the container may be ingested therethrough by a consumer. This arrangement avoids tearing of the peripheral curl and therefore maintains the curl integrity of the lid.

2. Description of the Background Art

Various drink-through container lids are known in the prior art. Most of these arrangements either involve a tear away portion which destroys the curl integrity of the lid or various flaps which may be punched inside the lid. These arrangements, however, are often unsatisfactory in sealing the lid and may be difficult for a user to conveniently operate in order to place the lid in a drink-through mode. These container lids require an operator to use two hands when opening the drink-through portion of the lid. The first hand must securely hold the lid and cup while the second hand is used to pry open the drink-through portion of the lid. Often, it is difficult for a user to exercise the care required for opening such lids and spills are common.

For instance, if a person were attempting to drive an automobile and open the container, it would be very difficult to use two hands for such a purpose. Thus, the operator is required to stop the vehicle, firmly grip the cup and lid and to somehow open the drink-through portion of the lid. Thus, this arrangement is an inconvenience for the user. Likewise, if a user was carrying some articles which prevent him or her from using the conventional two-handed opening method, it would be difficult to place the lid in a drink-through mode. Furthermore, even when convenient for a user to open the drink-through portion of the lid, such often required extra care to avoid spilling the contents or actually pulling the lid from the cup.

Accordingly, a need in the art exists for a simple and effective detachable drink-through container lid. This lid should be easy to operate, should maintain the integrity of the curl and should provide for a reliable seal such that the contents of the container will not easily be spilled therefrom.

SUMMARY OF THE INVENTION

Accordingly, it is a primary object of the present invention to provide a detachable, drink-through container lid which will effectively close a container and prevent spills therefrom.

It is another object of the present invention to provide a detachable, drink-through container lid which may be easily applied to a container and which has a drink-through portion requiring the use of only one finger for forming an opening therein.

It is a further object of the present invention to provide a detachable, drink-through container lid which avoids peripheral tearing of the lid when placing the lid in a drink-through mode, thereby maintaining curl integrity.

Another object of the present invention is to provide a new and novel detachable, drink-through container lid which may be easily attached on conventional beverage containers.

It is another object of the present invention to provide a new and novel detachable, drink-through container lid which may be reliably, accurately and inexpensively manufactured.

These and other objects of the present invention are fulfilled by providing a detachable, drink-through container lid for open-mouthed containers having a peripheral rim defining the open mouth thereof. These lids comprise peripheral curl means defining a rim receiving cavity, central web means and drink-through means having a raised element and a well portion. The raised element is positioned within the well portion and the drink-through means is surrounded by the central web means. The rim receiving cavity extends around the periphery of the lid and is arranged to receive the rim of the container in order to retain the lid thereon. The central web means extends across the container lid within an area defined by said peripheral curl means and gives support to the lid. The raised element located in the well portion of the lid has a plurality of corners. In the forming process, the corners are naturally stressed such that a slight force exerted against the top surface of this raised element will cause those areas adjacent the corners and generally defined by the corners themselves to fracture and eye-shaped slits or openings to be formed at each of these corners. The contents of the container may then be ingested from the well portion through these slits, thus providing a drink-through lid.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
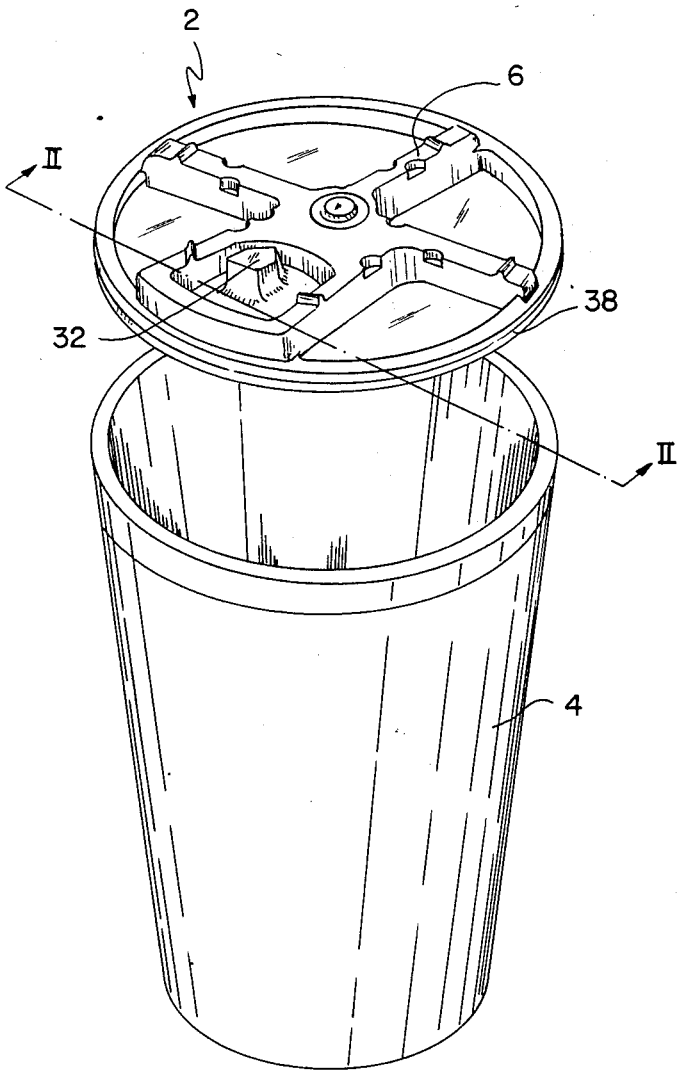
FIG. 1 is a perspective view of the detachable, drink-through container lid of the present invention with a container therefor.
Figure 4:
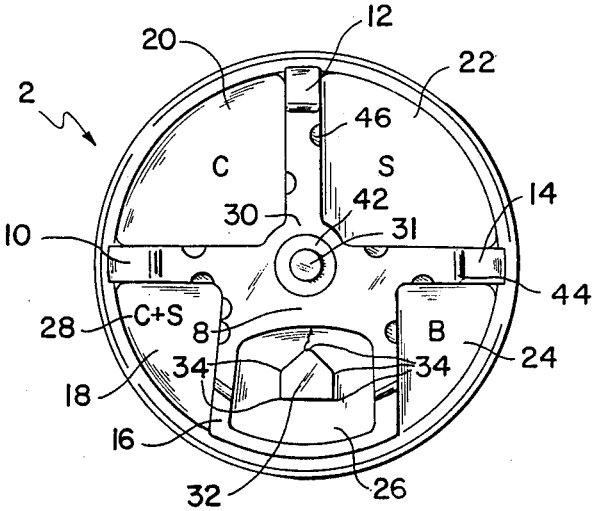
FIG. 4 is a top view of the detachable, drink-through container lid of the instant invention before slits are formed therein.

Referring to the drawings and with particular reference to FIG. 1, a detachable, drink-through container lid 2 is shown. This container lid 2 may be detachably affixed to a container 4. The container lid 2 includes a central web means 6. As seen in FIG. 4, this web means includes a first, second, third and fourth leg portion 8, 10, 12 and 14, respectively as well as cavities 18, 20, 22 and 24 therebetween. While only four leg portions are shown in FIG. 4, it is contemplated that a plurality of leg portions may be used.

The first leg portion 8 includes an end portion 16 which encircles a raised element 32. The portion 16 of leg 8 forms a drink-through means with a well area 26 for receiving the raised element 32. This raised element 32 has five corners 34. While the raised element 32 is shown as being a pentagon element, it is contemplated that a triangle-shaped, rectangular shaped or any other suitable configuration may be employed. It is merely necessary that this raised element have a plurality of corners adjacent which slits are to be formed as will be described below.

Figure 2:
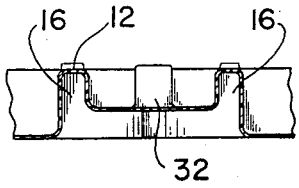
FIG. 2 is a cross-sectional view taking along line II—II of FIG. 1 showing the raised element before the slits are formed.

In particular, as shown in FIG. 2, a raised element 32 resides in a sealed bottom portion of the drink-through means of the well area 26. In this position and after the container lid 2 has been inserted onto the container 4, an effective seal is formed. In this arrangement, discharge of materials from the container is prevented.

Figure 3:
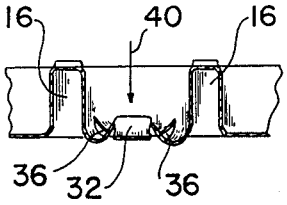
FIG. 3 is a cross-sectional view similar to FIG. 2 showing the raised portion after the slits are formed.
Figure 5:
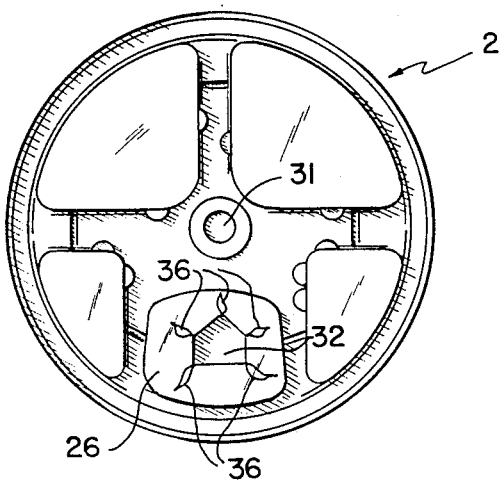
FIG. 5 is a top plan view of the detachable, drink-through container lid of the instant invention after slits are formed therein.

However, as seen in FIG. 3, a downward force 40 may be applied to the top surface of the raised element 32. This downward force 40 causes slits 36 in the shape of eyes to be formed at frangible areas adjacent the corners of the raised element 32. These frangible areas the corners themselves the corners 34 and extend to the web defining the bottom of the well area 26. Such slits 36 are indicated in both FIGS. 3 and 5. Once these slits are formed, the container's contents may be easily discharged therethrough. Various shapes can be used for these slits which will affect the amount of liquid that can be discharged from the lid. For instance, the taller the raised element 32 is, the greater the size of the openings will be. Therefore, variations in the rate of the amount of fluid discharged can be obtained.

For instance, if container 4 were to hold coffee or another beverage, the container lid 2 would be initially placed upon container 4 to enclose these contents. When desired to remove the beverage from the container, a user would merely apply a slight downward force against the top surface of the raised element 32. This force would cause the corners to fracture and thus, slits 36 to be formed at each corner of the raised element. The user may then drink the beverage from the container through the drink-through means having slits 36. Such an arrangement maintains the Curl integrity of the container lid 2 such that the lid will not fall from container 4. Furthermore, the slight force 40 may be generated by an operator gripping the cup with one hand and with the thumb or forefinger of that hand applying a slight downward force to the top surface of raised element 32. Thus, a one-handed operation may be carried out for permitting discharge f the container's contents.

As seen in FIG. 4, the web portion 6 has a central area 30. On this area, the trademark for the manufacture of the lid or other indicia may be located. Furthermore, a vent 31 may be provided in this central area 30. This vent is surrounded by a groove or moat 42. This moat will contain any liquid which may be discharged from vent 31. This vent allows even discharge of the container's contents when the slits 36 are formed. Further, this vent permits any changes in pressure between the closed container and the outside environment to be equalized.

The leg portions 8, 10, 12 and 14 form respective cavities 18, 20, 22 and 24 thereinbetween. These cavities may have indicia 28 thereon. Such indicia may indicate the contents of the container. For instance, if coffee with cream and sugar is held within container 4, the indicia 28 in cavity 18 may be marked. Thus, rapid identification of the container's contents may be carried out. Furthermore, marking of such indicia may be easily accomplished by a vendor or the like.

While the container 4 has been discussed as containing a beverage, it is contemplated that any type of liquid or pulverulent material may be held within the container lid 2. For instance, liquids other than coffee and soda may be held within the container 4 and discharged through the lid 2.

It is additionally noted that when the raised element 32 has a downward force 40 applied thereto, and eye-shaped slits 36 are formed, the peripheral curl means 38 of the container lid 2 is maintained. Furthermore, the raised element 32 will not be inserted into the interior portion of the container 4. Thus, the probability that this raised element will become detached from the container is greatly decreased. The safety of the container lid is therefore enhanced as it is unlikely that a user will accidentally swallow any portion thereof.

Furthermore, a sharp edge around the opening of the container upon which a user may cut his or her lip is avoided. This arrangement therefore also increases the safety of the container lid 2 of the instant invention.

Also, as the raised element 32 remains attached to the container lid 2, there is no separate piece to discard. Thus, problems of littering are reduced.

As seen in FIG. 2, the top surface of the element 32 is initially above the top surface of the web portion 6. This design reduces the likelihood that heated contents within the container 4 would contact the raised element 32 such that the raised element would be at a temperature whereat a user's finger could be burned when touching element 32. This design for the top surface of the raised element 32 may also be used when the container's contents are not heated.

As further seen in FIGS. 2 and 3 of the instant application, when the raised element 32 is depressed to form slits 36, the top surface of this element remains in a plane which is substantially parallel to the plane in which the top surface of element 32 initially resided. This feature enables a force to be applied to the raised element 32 without great precision. In other words, a downward force and then a lateral force in order to move the raised element out of the way is not necessary in the device of the instant invention. The container lid 2 may therefore be easily and quickly placed in a drink-through mode with minimal attention from the user. Such a feature enhances ease of use of the container lid 2 and avoids a jerking or pulling motion which is likely to result in spills.

Further, the well area 26 of the container lid 2 may function to contain any excess liquid residue after partial discharge of the liquid from container 4. This well area 26 thus aids in the prevention of spills from container 4. This well area 26 also permits any liquid which may seep from container 4 to be collected therein. Such seepage may occur when the container is initially filled and after the slits 34 are formed therein.

The web portion 6 of the container lid 2 enhances the stability of this lid and gives support thereto. While an arrangement of four legs has been illustrated, it is contemplated that any number of leg portions may be used. This web portion 6 also prevents the container lid 2 from becoming detached from the container 4 or from being deformed when a user drinks through lid 2. In the absence of web portion 6, downward pressure on the top surface of the lid 2 may deflect portions of the lid so as to disturb the snap connection between the lid 2 and the container 4. However, with web portion 6, the likelihood of undesirable deflection of the lid 2 is reduced.

This web portion 6 gives an area for enhancing stacking of the lids to stack other cups of liquid on as is necessary when purchasing more than one drink. Lugs 44 can be placed in these ribs or webs to prevent stacked cups from sliding off. Further, anti-compacting lugs formed by different lugs on every other mold can be used to prevent compacting or stocking of stacked lids. Such lugs will also enable the lids to be stacked evenly when on a store counter or the like.

It is contemplated that the container lid 2 may be made from any suitable flexible material such as plastic. This lid 2 can therefore be easily and accurately manufactured with minimum costs.

While the lid 2 has been shown as being used with a circular container 4, it should be understood that it can be adapted for use on ordinary containers used for a variety of purposes and having a variety of configurations.

It is further contemplated that the drink through lid of the present invention can be used to provide a straw slot for cold drink lids, while providing a spill proof lid enclosure until the straw pushes the raised element down in the well to form an opening.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A detachable, drink-through lid for open-mouthed containers having a peripheral rim defining the open-mouth thereof comprising:

peripheral curl means defining a rim receiving cavity extending around a periphery of said lid, said cavity detachably receiving said rim of said container in order to retain said container lid on said container;

central web means extending across said container lid;

drink-through means comprising a well portion defined by said central web means and a raised element positioned within said well portion, said raised element having a plurality of corners and a top surface, said raised element including relatively frangible areas adjacent said corners, said well portion of said lid initially being sealed when said container lid is received on said container, whereafter a pressure exerted on said top surface of said raised element causes slits to be formed adjacent said corners in said relatively frangible areas while avoiding deformation of said peripheral curl means, said slits permitting contents within said container to be dispensed therethrough and ingested from said well portion, said well portion having a bottom which is positioned above a bottom of said central web means before said slits are formed.

2. The detachable container lid as recited in claim 1, wherein said frangible areas are defined by an area extending from said corners toward the bottom of said well portion.

3. The detachable container lid as recited in claim 1 wherein said slits, when formed, radiate outwardly from said plurality of corners of said raised element and wherein said raised element remains attached to said lid after said slits are formed.

4. The detachable container lid as recited in claim 3, wherein said frangible areas are defined by an area extending from said corners toward the bottom of said well portion.

5. The detachable container lid as recited in claim 1, wherein said top surface of said raised element is located in a first plane before said slits are formed, said central web means further having a top surface which is located in a second plane, said second plane being between said first plane and the contents within said container at least before said slits are formed whereby said contents will be precluded from contacting said top surface of said raised element.

6. The detachable container lid as recited in claim 1 wherein said top surface of said raised element is located in a first plane before said slits are formed and said top surface of said raised element is located in a second plane after said slits are formed, said first and second planes being generally parallel.

7. The detachable container lid as recited in claim 6, wherein said central web means further has a top surface which is located in a third plane, said third plane being between said first plane and the contents within said container at least before said slits are formed whereby the contents will be precluded from contacting said top surface of said raised element.

8. The detachable container lid as recited in claim 6, wherein said frangible areas are defined by an area extending from said corners toward the bottom of said well portion.

9. The detachable container lid as recited in claim 1 wherein said raised element is pentagonal in shape in a cross section taken generally parallel to said top surface of said raised element such that said raised element has only five corners for forming only five slits when said pressure is exerted on said raised element.

10. The detachable container lid as recited in claim 9, wherein said frangible areas are defined by an area extending from said corners toward the bottom of said well portion.

11. The detachable container lid as recited in claim 1, wherein said lid is flexible.

12. The detachable container lid as recited in claim 11, wherein said lid is plastic.

13. The detachable container lid as recited in claim 11, wherein said vent is encircled by a moat, said moat acting to contain any of the contents of the container which exit said vent.

14. The detachable container lid as recited in claim 1 wherein said central web means has an opening therein for providing a vent for said container after said lid is retained thereon, said opening on said central web means being the only opening for said container after said lid is inserted thereon and before said pressure is exerted to form said slits for effectively sealing said container.

15. The detachable container lid as recited in claim 1 wherein said central web means provides support for said lid and includes a plurality of legs radiating from a central portion of said lid toward said periphery of said lid.

16. The detachable container lid as recited in claim 1 wherein said central web means includes a plurality of legs radiating from a central portion of said lid toward said peripheral curl means, said leg portions being raised from a surface of said lid such that cavity portions are formed between said legs.

17. The detachable container lid as recited in claim 16 wherein said cavity portions have indicia therein for indicating at least a portion of said contents of said container.

18. The detachable container lid as recited in claim 16 wherein one of said plurality of legs has a portion surrounding said well portion and said plurality of slits after said slits are formed.

19. The detachable container lid as recited in claim 1 wherein said contents of said container are liquid and wherein said drink-through means permits a user to drink said liquid directly from said container through said slits in said well portion.

20. The detachable container lid as recited in claim 1, wherein said raised element protrudes upwardly both before and after the pressure is exerted whereby the top surface of said raised element remains above the bottom of said well portion.

* * * * *